US008821324B1

(12) United States Patent
Potthast

(10) Patent No.: US 8,821,324 B1
(45) Date of Patent: Sep. 2, 2014

(54) ADJUSTABLE BASE ASSEMBLY AND METHOD OF USING SAME

(75) Inventor: Robert M. Potthast, Crystal Lake, IL (US)

(73) Assignee: Robert M. Potthast, Crystal Lake, IL (US)

( * ) Notice: Subject to any disclaimer, the term of this patent is extended or adjusted under 35 U.S.C. 154(b) by 277 days.

(21) Appl. No.: 13/185,103

(22) Filed: Jul. 18, 2011

Related U.S. Application Data

(60) Provisional application No. 61/365,795, filed on Jul. 20, 2010.

(51) Int. Cl.
*A63B 71/00* (2006.01)
*A63B 69/00* (2006.01)
*A63B 71/02* (2006.01)

(52) U.S. Cl.
CPC ..... *A63B 69/0013* (2013.01); *A63B 69/0002* (2013.01); *A63B 2071/024* (2013.01); *A63B 2069/0008* (2013.01)
USPC ..... 473/499; 473/451; 473/452

(58) Field of Classification Search
CPC ..... A63B 69/0002; A63B 69/0013; A63B 2069/0008; A63B 2071/024
USPC ..... 473/497, 499–501, 422, 451, 452
See application file for complete search history.

(56) References Cited

U.S. PATENT DOCUMENTS

| | | | | |
|---|---|---|---|---|
| 2,695,784 | A * | 11/1954 | Orsatti et al. | 473/499 |
| 3,862,756 | A * | 1/1975 | Selliken | 473/501 |
| 4,398,715 | A * | 8/1983 | Hall | 473/501 |
| 4,531,733 | A * | 7/1985 | Hall | 473/501 |
| 4,976,430 | A * | 12/1990 | Brandon | 473/501 |
| 5,318,290 | A * | 6/1994 | Sawyer | 473/217 |
| 6,077,175 | A * | 6/2000 | Fearnow | 473/468 |
| 7,648,432 | B1 * | 1/2010 | Hall | 473/499 |
| 7,874,943 | B1 * | 1/2011 | Chen | 473/501 |
| 8,070,631 | B2 * | 12/2011 | Nimmons | 473/499 |
| 8,337,340 | B2 * | 12/2012 | Clark | 473/497 |

* cited by examiner

*Primary Examiner* — Mitra Aryanpour
(74) *Attorney, Agent, or Firm* — Law Offices of Potthast & Associates

(57) ABSTRACT

An adjustable base assembly (10) having a base connector (30) and a base mounting platform (14) with a mating base connector (32) releasably connectable with the base connector (30) with a mounting stud (36) for attaching the bottom (26) against a playing surface (28). The connector (30) and the mating base connector (32) have at least two pairs of mating surfaces including one pair of locking surfaces (40 and 42) that prevents separation of the base (12) from the base mounting platform (14) in response to any lateral forces. Other pairs of different non-locking, mating engagement surfaces (48 and 50, 54 and 56, and 60 and 62) enable separation of the base (12) from the base platform (12) in response to different preselected minimum lateral threshold forces applied against another one of the sidewalls (18, 22 and 16).

35 Claims, 5 Drawing Sheets

ADJUSTABLE BASE ASSEMBLY AND METHOD OF USING SAME

CROSS-REFERENCE TO RELATED APPLICATION

This application claims the benefit under 35 U.S.C. 119(e) of U.S. provisional patent application 61/365,795, filed Jul. 20, 2010, of the present inventor and entitled "Adjustable Base Assembly and Method of Using Same", which is hereby incorporated by reference.

BACKGROUND OF THE INVENTION

1. Field of the Invention

This invention generally relates to a base assembly used during the game of baseball or softball and a method of using same, and, more particularly, to such a base assembly is adjustable with respect to the minimum amount of lateral force imparted to the side of the base when a player slides into the base to cause the base to break away.

2. Discussion of the Prior Art

Base assemblies that are not adjustable but are fixedly attached or locked to the playing surface and will not breakaway are well known. These non-breakaway base assemblies have a base fixedly mounted to a base mounting member and are not released in response to lateral force applied to the base. Such non-breakaway base assemblies are generally only used in professional baseball leagues and the like.

Break away safety base assemblies are also well known and are generally used only in amateur league play in which the players may be less skilled at "sliding in to base". Such safety base assemblies have a base releasably secured to the playing surface of the ball field by means of a releasable base mounting member. The releasable mounting member enables the base to separate from the releasable base mounting member when a player slides into the side of the base, to reduce the risk of injury that could otherwise result when using a non-breakaway base assembly. Commonly, such breakaway base assemblies are not adjustable with respect to the amount of minimum lateral force that must be imparted to the base to cause it to break away.

It is also known to provide such a breakaway safety base assemblies with a mounting member that is more resistant to breaking away when engaged by a force in one direction as opposed to another direction. However, a problem with such a known adjustable breakaway safety base assembly is that the adjustment is only possible in two of the four possible directions from which the base may be struck. The minimum breakaway threshold force for both sides of one of the pairs of adjacent sides are at the same one force level, and the breakaway threshold force for both sides of the remaining pair of adjacent sides are at the same level that is different from the one force level. Another disadvantage of this known adjustable breakaway base is that the breakaway mechanism depends upon the distortion of flexible interconnecting members that may vary from one composition to the next and which may change over time due to decomposition and mechanical fatigue and are susceptible to damage from regular use.

In known non-breakaway base assemblies that preclude breakaway action, there is no possibility of adjustment to enable breakaway, and such locked base assemblies lack the ability as may be needed to selectively enable either breakaway action or not.

SUMMARY OF THE INVENTION

It is therefore an object of the present invention to provide an adjustable breakaway base assembly and method of using same that overcomes the problems with known breakaway safety bases and methods.

This objective is achieved in part by provision of an adjustable base assembly, with a base with four side walls, a top and a bottom, the bottom carrying a base connector, a base mounting platform having a mating base connector releasably connectable with the base connector, and means for attaching a bottom of the base mounting platform against a playing surface, and in which the base connector and the mating base connector having at least two pairs of mating engagement surfaces including one pair of locking, mating engagement surfaces that prevents separation of the base from the base mounting platform in response to any lateral forces applied against one of the side walls of the base, and another pair of non-locking, mating engagement surfaces that enables relative movement between and separation of the base from the base platform in response to a preselected minimum lateral threshold force applied against another one of the sidewalls.

The one pair of locking engagement surfaces includes a convex engagement surface of one of the base and the base mounting platform, and a complementary mating concave engagement surface of another of the base and base mounting platform that is received within the convex surface. In one embodiment both the convex engagement surface and the complementary concave engagement surface include a pair of planar segments that meet along a line that is generally parallel to the one side of the base. In another embodiment the convex engagement surface and the complementary concave engagement surface include a pair of arcuate segments that meet along a line that is generally parallel to the one side of the base. The locking mating engagement surfaces extend in a direction that is substantially parallel to the one side of the base and adjacent to the one side of the base.

Preferably, the non-locking, engagement surfaces are generally planer and meet along a single plane and forms a non-obtuse angle relative to the bottom of the base. The angle may be an acute angle relative to the bottom of the base in a range approximately between twenty degrees and seventy five degrees. The non-obtuse angle may also be right angle relative to the bottom.

In keeping with one aspect of the invention, the non-locking, mating engagement surfaces are rigid and separable from each other in response to a lateral force against the other side of the base without distortion.

In one embodiment another pair of locking, mating engagement surfaces that prevents separation of the base from the base mounting platform in response to any lateral forces applied against a third one of the side walls of the base is provided and another pair of non-locking, mating engagement surfaces that enables relative movement between and separation of the base from the base platform in response to a preselected minimum lateral threshold force applied against a fourth one of the side walls is provided. Preferably, the one side and the other side are opposite one another, and the third side and the fourth side are opposite one another.

Alternatively, the adjustable base is provided with one locking side and three different non-locking sides with either the same or different minimum threshold forces required for breakaway action in response to a slide into base.

The objective of the invention is also obtained by providing an adjustable base assembly, having a base with four side walls, a top and a bottom, the bottom carrying one of a base connector and a mating base connector, a base mounting platform having another one of the base connector and the mating base connector and having means for attaching the bottom of the base mounting platform to a playing surface, and said base connector and mating base connector including at least one pair of relatively rigid, non-locking, mating engagement surfaces, respectively, that enables relative sliding movement between and separation of the non-locking engagement surfaces without significant distortion in response to a preselected minimum lateral threshold force against one of the sidewalls of the base. Preferably, the mating engagement surfaces engage along a plane that forms an acute angle relative to the bottom, and the mating engagement surfaces engage along a plane that extends inwardly and upwardly.

The objective is also acquired in part by providing an adjustable base assembly, with a base with four side walls, a top and a bottom, the bottom carrying one of a base connector and a mating base connector; a base mounting platform having another one of the base connector and the mating base connector and having means for attaching the bottom of the base mounting platform to a playing surface, and said base connector and mating base connector having at least three non-locking, mating engagement surfaces that enables relative movement between and separation of the base from the base platform in response to three different, minimum, lateral threshold forces against three different one of the side walls.

The objective of the invention is also partly obtained by provision of an adjustable base assembly, with a base with four side walls, a top and a bottom, the bottom carrying a base connector: a base mounting platform having a mating base connector releasably connectable with the base connector, and means for attaching a bottom of the base mounting platform against a playing surface; the base connector and the mating base connector having at least one pair of mating engagement surfaces including a pair of non-locking, mating engagement surfaces that enables relative movement between and separation of the base from the base platform in response to a preselected minimum lateral threshold force applied against another one of the sidewalls, and means for selectively locking the pair of non-locking, mating engagement to prevent separation of the base from the base mounting platform in response to any lateral forces applied against one of the side walls of the base.

In one embodiment the locking means is a base releasably attached to the bottom of the base and the bottom of the base mounting platform, and the base is releasably attached by means of rotatable fasteners that extend through the base and into each of the bottom of the base and the bottom of the base mounting platform.

In another embodiment, the locking means includes a movable latch with a latch holder mounted to the bottom of one of the base and the base mounting platform and a latch member movably mounted to the latch holder for movement between an unlocked position in which the latch holder extends beneath another one of the base and base mounting platform and an unlocked position in which the latch member in which the latch member is in a withdrawn position spaced from the other one of the base and base mounting platform.

Preferably, the latch is mounted for linear or rotary movement relative to the latch holder between the locked position and the unlocked position, and the latch member is fixedly attached to the bottom of the base and the latch member is mounted for sliding movement beneath the bottom of the base mounting platform. Each of the four sides may be provided with breakaway capability with the same or different minimum lateral threshold forces and each of the four sides are provided with a movable locking member such that any one of the four sides may be selectively converted to a locking side which prevent breakaway action.

The objective is also achieved by providing a method of using a base assembly, by performing the steps of facing a side of the base associated with a pair of locking surfaces that prevent separation of a base from a base mounting platform in response to lateral forces against the side during slides into the base in the direction of normal base running, and facing another side of the base associated with a pair or non-locking surfaces that allow relative movement and separation of the base from the base platform in response to lateral forces against the other side during slides into the base in the direction of normal base running.

BRIEF DESCRIPTION OF THE DRAWINGS

The forgoing objects, features and advantages will be described in detail and other advantageous features will be made apparent from the Detailed Description below that is given with reference to the several figures of the drawing, in which:

FIG. 4 is a plan view of the base mounting platform;

DETAILED DESCRIPTION

Figure 1:
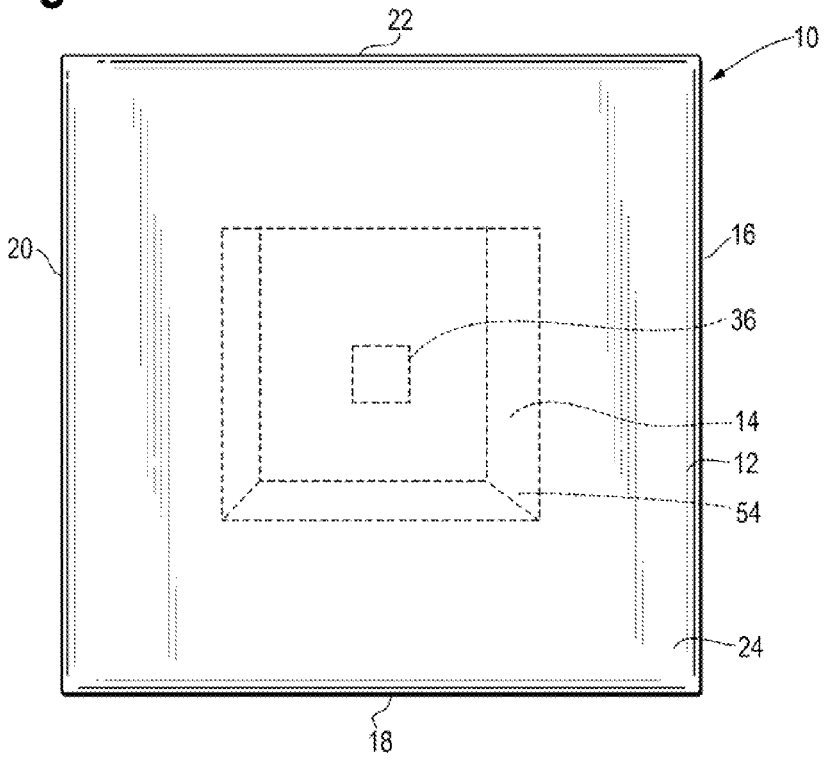
FIG. 1 is a top view of the adjustable base assembly.
Figure 2:
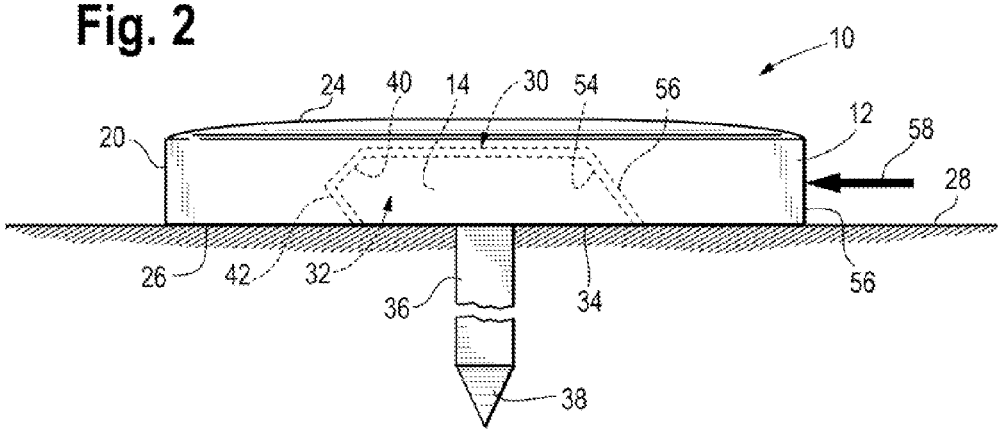
FIG. 2 is a side view of the adjustable base assembly of FIG. 1.

Referring to FIGS. 1 and 2, a preferred embodiment of the adjustable base assembly 10 of the present invention is seen to include a base 12 which overlies and is releasably attachable to a base mounting platform 14. The base 12 is shaped in a square with each of four sides 16, 18, 20 and 22 having a length of approximately fifteen inches. The width, or height, of the four sides 16, 18, 20 and 22 is approximately 2.0-inches, and the peak of the convexly curved top 24 of the base 12 is approximately 2.5-inches. The base 12 and the base mounting platform 14 are preferably made of molded hard rubber, synthetic rubber or other like relatively hard, inflexible plastic or other material that is resistant to ultraviolet light deterioration and which is relatively impermeable to water and is generally weather resistant. The phrases "relatively inflexible" or "relatively hard", as used herein, means that for purposes of breakaway action that is described below, neither the base connector of the base nor the mating base connector of the base mounting platform significantly distort under the normal forces being applied as needed to cause the breakaway action. Although, the relatively inflexible material may be somewhat elastomeric, one of the advantages of the current adjustable base assembly is that substantial distortion is not required such that material fatigue and resultant deterioration are avoided.

Figure 3:
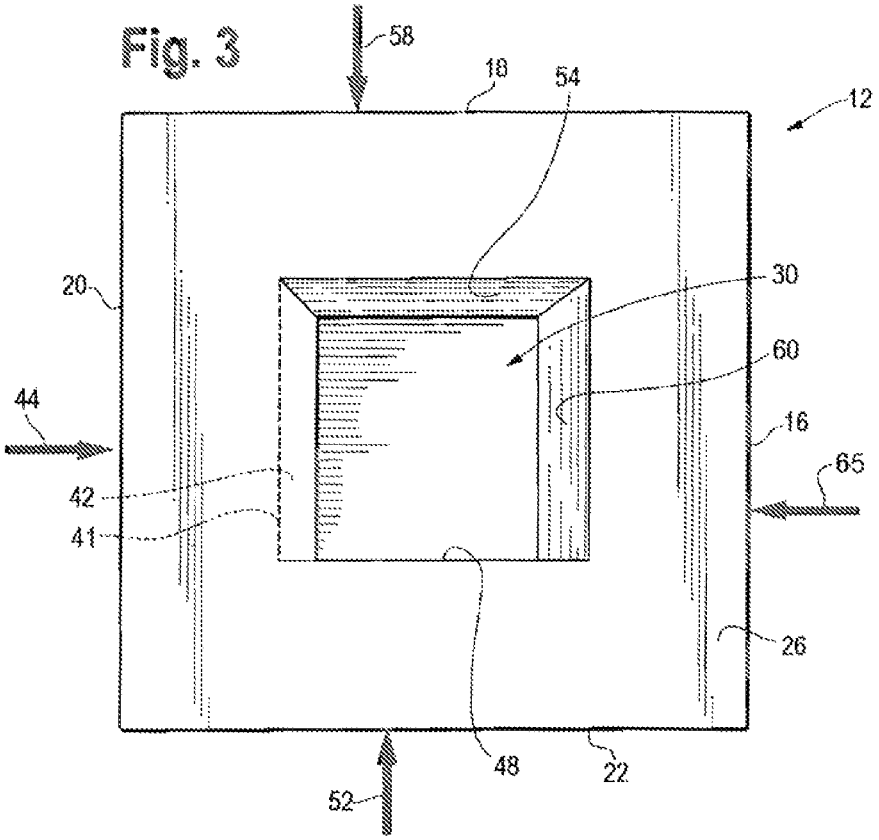
FIG. 3 is a side view of the adjustable base assembly of FIG. 1.

The base 12 may be partially hollowed out to reduce the amount of material needed with parallel or intersecting support walls with distal ends that generally terminate at a plane aligned with the bottoms of the side walls, and, such plane is referred to herein as a generally flat bottom, or generally planer bottom 26. The generally flat bottom 26 is supported on the surface 28 of the turf of the playing field. As best seen in FIG. 3, the base 12 has a base connector 30 which is received within the central interior of the base 12 and fits together with a mating base connector 32 of the base mounting platform 14. When the mounting base connector is fully connected with the mating base connector 30, a flat bottom 34 of the base mounting platform 14 is flush with the flat bottom 26 of the base 12 and also rests upon the surface of the turf 28. The parts are dimensioned appropriately to provide a sufficient amount of clearance between the mating parts of the base connector 30 and the mating base connector 32 allow ease of connection and breakaway action as described below.

The base mounting platform 14 includes a mounting stud 36 fixedly mounted to and extending perpendicularly downwardly from the center of the flat bottom 34 for releasably anchoring the base mounting platform 14 to a playing surface 28. Preferably, the mounting stud 36 is adapted to be vertically, slidably received within or around an elongate, vertical, mating, square, elongate, base anchor socket member, or peg member, 38. The socket member 38 may be permanently installed into a concrete block (not shown) poured beneath the playing surface 28, but preferably the socket member 38 has merely been driven into the turf beneath the surface 28 in accordance with the invention shown and described in U.S. Pat. No. 4,790,533 issued Dec. 13, 1988 to Clarence H. Potthast, Sr. for an invention in "Baseball Base Setting Apparatus", which is hereby incorporated by reference. The mounting stud 36 and the peg member are preferably made of steel or other rigid material. The mounting stud 36 has a square cross-section that is approximately 1.5-inches to the side and has a length of approximately four to five inches. In accordance with the invention, the base 12 is attached to the playing surface 28 via the attachment to the base mounting platform 14.

Preferably, the base connector 30 carried by the base 12 is preferably a female base connector formed in and carried by the bottom 26. In such case, the mating base connector 32 is a male base connector extending upwardly from the top of the mounting stud 36 and the bottom 34 and into the mating female base connector 30. The male base connector 32 has a plurality of male engagement surfaces that snugly mate with a corresponding plurality of mating female engagement surfaces of the female base connector 30. Alternatively, the male base connector 32 is attached to the bottom 26 of the base 12 and the female connector is anchored to the playing surface 28.

The base connector 42 and the mating base connector 41 have at least two pairs of mating engagement surfaces including one pair of locking, mating engagement surfaces that prevents separation of the base 12 from the base mounting platform 14 in response to any lateral forces applied against side 20 of the base 12. The one pair of locking engagement surfaces includes a convex engagement surface 40 of the male base connector 32 and a complementary mating concave engagement surface 42, FIG. 2 of the base mounting platform 14 that is snugly received within the mating convex surface 40. Both the convex engagement surface 40 and the complementary concave engagement surface 42 include a pair of intersecting planar segments that meet along a line straight line 41 that is generally parallel to the one side 20 of the base 12 and parallel to the bottom 26.

Figure 8:
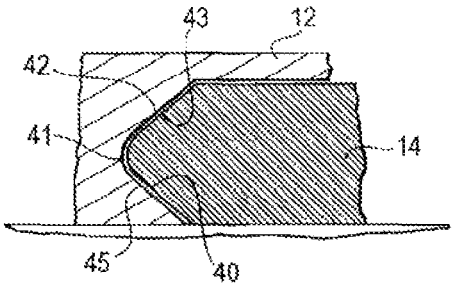
FIG. 8 is a cross-sectional side view of an another configuration of the locking engagement surfaces shown in FIG. 6.
Figure 9:
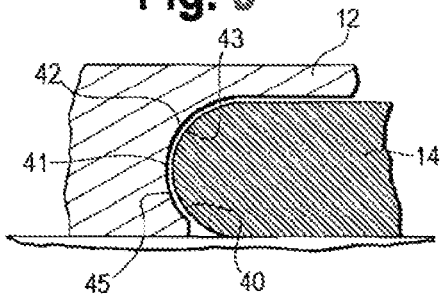
FIG. 9 is a cross-sectional side view of yet another configuration of the locking engagement surfaces shown in FIGS. 6 and 8.
Figure 10:
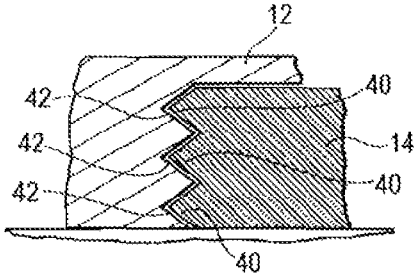
FIG. 10 is a cross-sectional side view of still another configuration of the locking engagement surfaces shown in FIGS. 6 and 8 and 9.

Alternatively, as seen in FIGS. 8 and 9, both the convex engagement surface 40 and the concave engagement surface 42 include a pair of arcuate segments 43 and 45 that meet along line 41 that is generally parallel to the one side 20 of the base 12. In FIG. 8 only part of the engagement surfaces are arcuate while in FIG. 9, the entire engagement surfaces are arcuate. Alternatively, as seen in FIG. 10, a plurality of V-shaped convex engagement surfaces 40 mate with a plurality of V-shaped concave surfaces 42, respectively. In all cases, the locking mating engagement surfaces extend in a direction that is substantially parallel to the one side 20 of the base 12 and are adjacent to the one side of the base.

Also, importantly in all configurations shown in FIGS. 6, 8, 9 and 10, the engagement surfaces have a lower segment that extends inwardly and downwardly and another upper segment that extends inwardly and upwardly. The lower segment directs the lateral force applied to side 20 during a slide into the base downwardly toward the playing surface 28, while the upper segment blocks the lower segment from wedging beneath the bottom 26 of the base 12 and lifting the mounting stud 36 vertically upward out of the socket member 38. In the case of a base mounting platform 14 that is permanently fixed to the playing surface and cannot be vertically lifted, it may be sufficient to rely upon on the playing surface 28 to block any over-travel by the lower segment.

Due to the interlocking relationship of the convex engagement surface 40 and the concave engagement surface 42, when lateral forces are applied to side 20 of the base 12, such as in the direction of arrow 44, the pair of locking surfaces 40 and 42 is pushed tighter together. The mating locking surfaces 40 and 42 block upward sliding movement of the base 12 relative to the base mounting platform 14 and thereby prevent relative sliding movement and ultimate separation of the base 12 from the base mounting platform 14.

Figure 7:
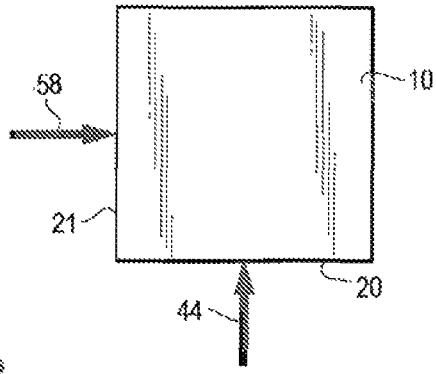
FIG. 7 is a plan view of the adjustable base assembly illustrating the method of adjustment of the present invention.

Accordingly, there is no movement of the base 12 relative to the std 36 anchored to the playing surface 28. Thus, in accordance with the method of the invention, when a game is being played in which it is desired to prevent the base from breaking away in response to the force of a slide, the base mounting platform 14 is anchored with the locking engagement surfaces 40 and 42 facing the normal direction of counter-clockwise base running, such as with surface 40 facing home base, first base or second base. While in the embodiment shown, only one of the four sides of the base assembly 10 is provided with mating locking surfaces, in accordance with one aspect of the invention each of two adjacent sides, such as side 20 and a side 22 of the base assembly 10 are provided with locking surfaces and arranged to respectively face the direction of both normal base running, as shown by arrow 44 and reverse baseball running as shown by arrow 58 in FIG. 7 to prevent breakaway action in both the counter-clockwise and clockwise directions.

Unlike the locking pair of mating surfaces 40 and 42, the other pairs of mating surfaces parallel to the other three sides are not in locking engagement but are non-locking engagement surfaces. Unlike the pair of locking mating surfaces 40 and 42, the pairs of non-locking, mating engagement surfaces enables relative movement between and separation of the base 12 from the base platform 14 in response to a preselected minimum, lateral, threshold force applied against an associated one of the other three sides 16, 18 and 22, FIG. 1. The non-locking, engagement surfaces are generally planer and meet along a single plane that forms a non-obtuse angle relative to the bottom 26 of the base, the bottom 44 of the base mounting platform 14 and the playing surface 28. The non-obtuse angle may be a ninety degree angle or an acute angle in a range between approximately twenty degrees and ninety-degrees. Like the locking, mating engagement surfaces all the non-blocking, mating engagement surfaces are preferably rigid and separable from each other in response to a lateral force against the other side of the base without significant distortion.

Figure 4:
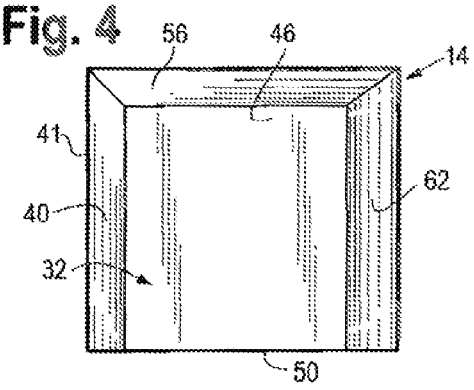
FIG. 4 is a bottom view of the base portion of the adjustable base assembly of FIGS. 1 and 2.
Figure 5:
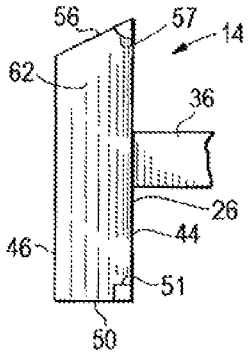
FIG. 5 is a side view of the bottom side of the base mounting platform of FIG. 4.
Figure 6:
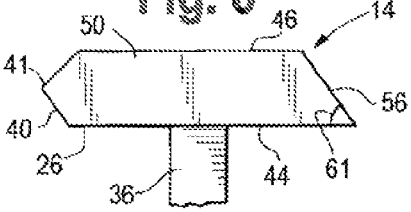
FIG. 6 is a side view of the right side of the base mounting platform of FIG. 4.

These non-locking engagement surfaces are merely congruent, planer rectangles lying in planes that form different obtuse angles relative to the flat bottom 26 and the flat playing surface 28 and relative to a flat bottom 44 and flat top 46 of the male connector 32 of the base mounting platform 14, FIGS. 4-6, None of the male mating surfaces of the male base connector 32 facing outwardly and downwardly like surface 40, and no female mating surfaces face inwardly and downwardly, like the surface of the arcuate segment 45. Accordingly, there are no mating locking surfaces, and the non-locking engagement of the surfaces enables relative movement between and separation of the non-locking engagement surfaces in response to a preselected minimum lateral force applied against one of the sidewalls to which they are adjacent and parallel. This enables the base 12 to slide upwardly and outwardly from engagement with base mounting platform 14 to "breakaway" when a sufficient minimum lateral threshold force is applied to the side.

It has been determined that the minimum amount of force required to cause a breakaway of the base 12 is directly dependent upon a non-obtuse angle that the plane of engagement of the mating surfaces makes with the bottom 26 of the base and with the flat bottom 44 and flat top 46 of the base mounting platform 14. Each of the pairs of non-locking engagement surfaces includes a pair of congruent planer surfaces of the same size and shape joinable together in overlying sliding relationship. The minimum force required for breakaway action is directly related to the magnitude of the non-obtuse angle. The larger the angle the greater the minimum amount of lateral force required to cause separation of the base 12 from the base mounting platform.

Referring to FIGS. 3-6, one rectangular, non-locking surface 48 of the female connector is perpendicular to the bottom 26 and mates with a non-locking rectangular surface 50 of the male connector that is perpendicular, i.e. forms a ninety-degree angle 51 relative to the bottom 44. The elongate non-locking surfaces 48 and 50 engage each other along a plane that is parallel to the direction of side 22. A first minimum lateral force in the direction of arrow 52 against the side 22 of the base is required to cause the base 12 to pivot up and lift off of the base mounting 14.

The other mating engagement surfaces engage along planes that extend inwardly and upwardly. Accordingly, when it is desired for breakaway to occur only when the first minimum force is received during a slide into the base 12 in the normal base running direction, the base 12 is positioned with the side 22 facing in the direction of normal base running i.e. facing home base, facing first base and facing second base.

Still referring to FIGS. 3-6, another rectangular, non-locking surface 54 of the female connector extends at an approximately sixty-seven degree angle relative to the bottom 26 and mates with a non-locking rectangular surface 56 of the male connector that extends at approximately sixty-seven degree angle 57 relative to the bottom 44 and the top 46. The elongate non-locking surfaces 54 and 56 engage each other along a plane that is parallel to the direction of side 18. A second minimum lateral force in the direction of arrow 58 against the side 18 of the base causes the base 12 to lift up and slide off of the base mounting platform 14 in the direction of arrow 58. The second minimum lateral force is less that the first, minimum, lateral threshold force associated with the mating surfaces 48 and 50. Accordingly, when it is desired for breakaway to occur only when the second, minimum, threshold force is received during a slide into the base 12 in the normal base running direction, the base 12 is positioned with the side 18 facing in the direction of normal base running, i.e. facing home base, facing first base and facing second base.

Another rectangular, non-locking surface 6 of the female connector 30 extends at an angle 61, FIG. 6, which is a forty-five degree angle relative to the bottom 26 and mates with a non-locking rectangular surface 62 of the male connector that extends at a forty-five degree angle relative to the bottom 44 and the top 46 of the base mounting platform 14. The elongate, non-locking, planer congruent surfaces 60 and 62 engage each other along a plane that is parallel to the direction of side 16. A third minimum lateral force in the direction of arrow 65 against the side 16 of the base causes the base 12 to lift up and slide of other base mounting platform 14 in the direction of arrow 65. The third minimum lateral force is less than the first minimum lateral force associated with the mating surfaces 48 and 50. Accordingly, when it is desired for breakaway to occur only when the third minimum lateral threshold force is received during a slide into the base 12 in the normal base running direction, the base 12 is positioned with the side 16 facing in the direction of normal base running, i.e. facing home base facing first base and facing second base.

Advantageously, the various pairs of non-locking surfaces are mounted for relative sliding movement and separation in response to at least the preselected minimum threshold force to enable separation without significant distortion. Because of this lack of distortion, resilient mechanical fatigue and the resultant weakening and deterioration is thereby avoided. Accordingly, the amount of force required for breakaway remains substantially the same despite repeated breakaway actions. Thus, in accordance with one aspect of the invention a base connector and a mating base connector are provided with at least one pair of relatively rigid, non-locking, mating engagement surfaces, respectively, that enables relative sliding movement between, and separation of the non-blocking engagement surfaces without significant distortion in response to a preselected minimum lateral threshold force against one of the sidewalls of the base. Preferably both the base 12 and the base mounting platform 14 are both molded from relatively inflexible material like hard rubber, hard imitation rubber or other like durable plastic that is impervious to weather and normal use.

While the embodiment of the adjustable base assembly shown in FIGS. 1-5, has been provided with three different non-locking engagement surfaces at three different sides, it should be appreciated that each of two adjacent sides may be provided with the same non-locking engagement surfaces with the same minimum lateral threshold force. Alternatively, all four sides may be provided with different non-locking engagement surfaces. Also, two adjacent sides may be provided with non-locking engagement surfaces with one lateral threshold force while the other two adjacent sides are provided with non-locking engagement surfaces having a different lateral threshold force from the first two adjacent sides. Another configuration contemplated by the invention is provision of two non-locking surfaces on two adjacent sides with the same lateral threshold force and the other two adjacent sides with locking engagement surfaces.

In any event, in accordance with the invention, the adjustable base assembly 10 is used by facing a side of the base associated with a pair of locking surfaces that prevents separation of a base from a base mounting platform in response to lateral forces against the side during slides into the base in the direction of normal base running when it is desired to prevent the base from breaking away, when locking engagement surfaces are provided. When it is desired to allow breakaway, the base assembly 10 is adjusted by facing another side of the base associated with a pair or non-locking surfaces that allow relative movement and separation of the base from the base platform in response to a preselected minimum lateral threshold force against the other side during slides into the base in the direction of normal base running.

Figure 11:
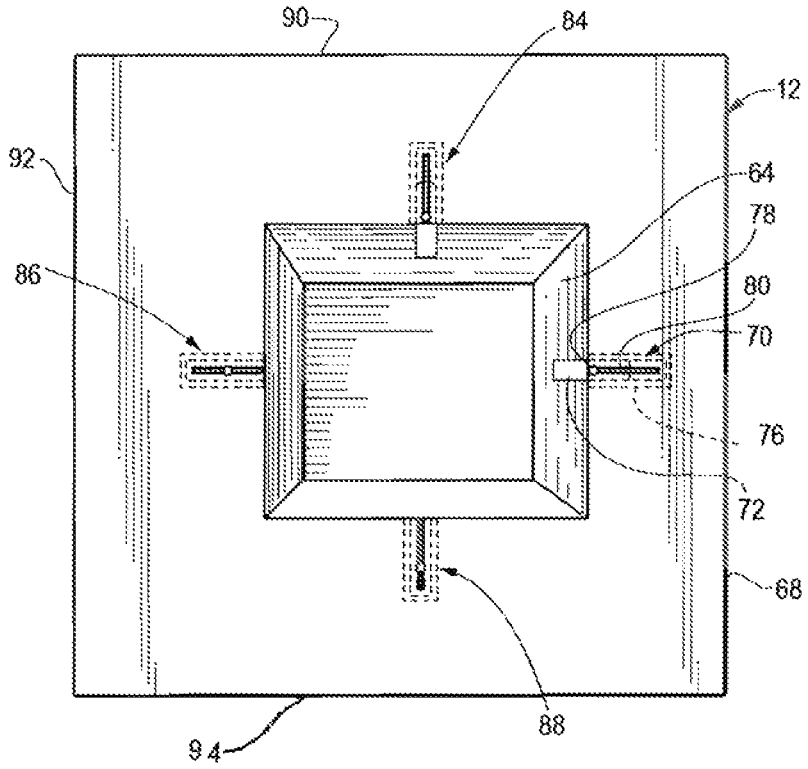
FIG. 11 is a bottom view of another form of the base of the present invention in which means are provided for selectively locking pairs of non-locking surfaces to prevent separation of the base from the base mounting platform.
Figure 12:
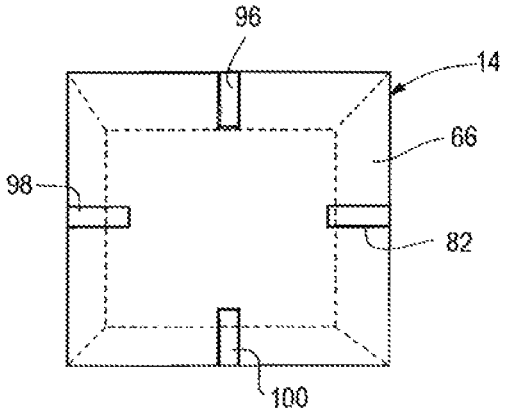
FIG. 12 is a bottom view of another form of the base mounting platform with undercut slots within which latch members of the locking means of the base of FIG. 11 are received to block separation.
Figure 13:
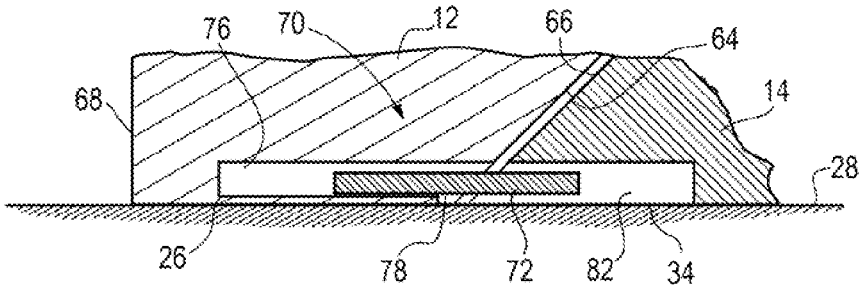
FIG. 13 is an enlarged sectional side view illustrating the one side of the base of FIG. 11 when locked to the base mounting platform of FIG. 12.

Referring now to FIGS. 11-13, another embodiment of the adjustable base of the present invention is illustrated in which the base 12 and the base mounting platform 14 are provided with a pair of non-locking mating engagement surfaces 64 and 66. Unless locked, the non-locking mating engagement surfaces 64 and 66 enable relative movement between and separation of the base 12 from the base platform 14 in response to a preselected minimum lateral threshold force applied against sidewall 68. However, when a locking mechanism 70 is selectively engaged into a locked position, the pair of no n-locking mating engagement surfaces 64 and 66 are locked together to selectively prevent separation of the base 12 from the base mounting platform 14 in response to any lateral forces applied against the sidewall 68.

The locking mechanism 70 includes an elongate latch member 72 that is slidably mounted within an elongate recessed latch holder 76 in the bottom 26 of the base 12. A short tab 78 on the bottom of the elongate latch member 72 extends downwardly though a slot 80 to enable manual engagement slide the elongate latch member 72 between an extended locked position and a retracted unlocked position. The tab 78 also bears against the end of the slot 80 to prevent removal of the entire latch member 72 from the latch holder 76.

In the locked position, as shown in FIGS. 11 and 13, a distal end of the elongate latch member 72 extends out of the latch holder 76 and into an aligned latch receiving latch holder 82 formed at the bottom 34 of the recessed latch holder 76. The distal end of the latch member 72 bears against the top of the latch receiving slot to prevent upward sliding movement of the base engagement surface 66 along the platform engagement surface 64 and thereby prevents separation of the base 12 from base platform in response to any lateral force against the base side 68.

Preferably, three other locking mechanisms 84, 86 and 88, substantially identical to the locking mechanism 70, are provided at the three other sides of the base 90, 92 and 94, respectively. The elongate latch members of the sliding lock mechanism 84, 86 and 88 respectively cooperate with and are received within latch receiving slots 96, 98 and 100 of the base mounting platform 14 of FIG. 12. In the unlocked position, as illustrated by the locking mechanisms 86 and 88, FIG. 11, the latch members are fully retracted within their respective latch holders 82 such that distal end of the latch members do not protrude into the associated latch receiving slots. In such case, the mating engagement surfaces are allowed to slidably move relative to enable breakaway action in response to the particular lateral threshold force associated with the particular angular configuration of the associated mating engagement surfaces.

In the base 12 of FIG. 11, maximum adaptability is obtained. Preferably, the mating engagement surfaces associated with locking mechanisms 70 and 84, of adjacent sides 68 and 90 are at a forty-five degree angle which will allow separation at one preselected lateral minimum threshold force, while the mating engagement surfaces associated with the locking mechanism 86 and 88 and adjacent sides 92 and 94 are at an approximately twenty-three degree angle which will both allow separation at another preselected lateral minimum threshold force that is greater than that associated with the forty-five degree angle. Alternatively, each of the four sides has different engagement surface angles and an associated different minimum breakaway threshold force. Thus, if breakaway action is desired at one level the base assembly 10 is directed one way and if break away action at a different level is desired the base assembly is directed the opposite way. If breakaway action form impact on any side is to be prevented, then the locking mechanism associate with that side is positioned into a locking position.

Figure 14:
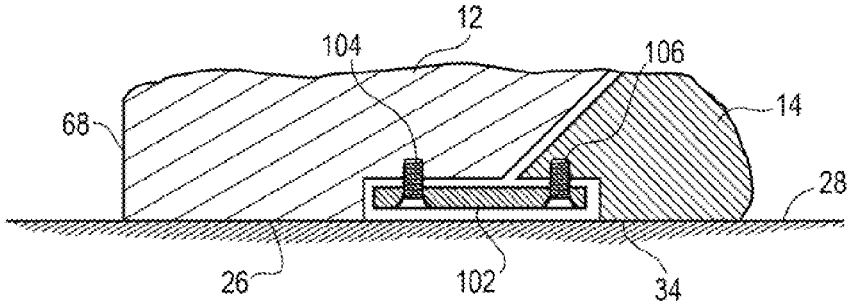
FIG. 14 is an enlarged sectional side view similar to that of FIG. 13 illustrating another locking means comprising a spanning base that is selectively fastened to the bottoms of both the base and the base mounting platform by means of threaded or other rotatable fasteners.

Referring to FIG. 14, another embodiment is shown in which selective locking against relative movement of the mating engagement surfaces is achieved by means of a lock member spanning base 102. The lock member is made of rigid durable material that is fastened by means of threaded or other rotatable fasteners 104 and 106 to both the bottom 26 of the base 12 and the bottom 34 of the base mounting platform 14 adjacent to the selected mating engagement surfaces for which breakaway is to be prevented.

Alternatively, in lieu of the rotatable fasteners 104 and 106, the lock member is releasably attached to the bottom 26 of the base 12 and the bottom 34 of the mounting platform 14 by means of Velcro® or Velcro®-like fasteners with an array of small hook like fasteners that releasably engage and attach to an array of loop like fasteners, both preferably made from spring steel or the like. The lock member 102 is preferably made from stainless steel plate material or the like. When the lock member 102 is not being used, it may be repositioned with respect to the fasteners so that it does not span the gap between the base and the mounting platform but, instead, is positioned lengthwise parallel to its associated side. Alternatively, the fasteners 104 and 106 are replaced by mating snap fasteners.

Figure 15:
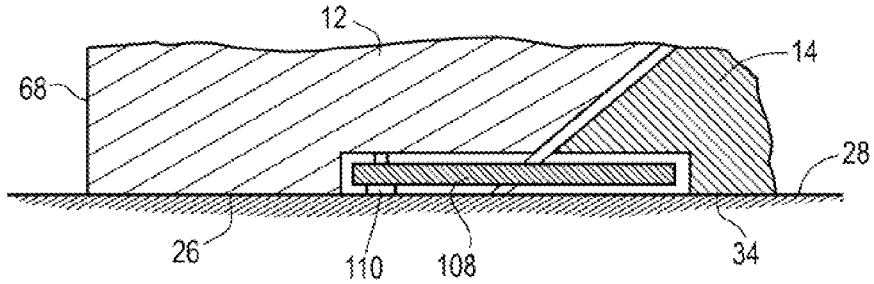
FIG. 15 is an enlarged sectional side view similar to that of FIG. 13 in which a rotatable latch member is employed to lock mating engagement surfaces against separation and prevent breakaway action.

Referring to FIG. 15, another embodiment is shown in which a rotatable latch member 108 is mounted for rotatable movement around a vertical pivot axle 110 between a locked position, as shown in FIG. 15, with a distal end of the latch member 108 located beneath an undercut in the bottom 34 of the base mounting platform 14, to an unlocked position in which the latch member is pivoted to a position spaced from the base platform.

It should be appreciated that while a particular embodiment has been shown and described in detail, many variations may be made to these details without departing from the spirit and scope of the invention. While particular dimensions have been illustrated, different dimensions of the mating parts may be successfully employed. Preferably, the vertical profile of the base mounting platform is as short as possible for the given connectors to still work together successfully to achieve the desired locking or breakaway characteristics. While the breakaway mating surfaces have been described as planer, a certain amount of curvature may be allowed while still obtaining the desired breakaway characteristics. Other equivalents and modification will occur to those of ordinary skill that are within the scope of the invention.

The invention claimed is:

1. An adjustable base assembly, comprising:

a base with four side walls, a top and a bottom, the bottom carrying a base connector;

a base mounting platform having a mating base connector releasably connectable with the base connector, and means for attaching a bottom of the base mounting platform against a playing surface;

the base connector and the mating base connector having at least two pairs of mating engagement surfaces including a pair of locking, mating engagement surfaces that prevents separation of the base from the base mounting platform in response to any lateral forces applied against one of the side walls of the base, and a pair of non-locking, mating engagement surfaces that enables relative movement between and separation of the base from the base platform in response to a preselected minimum lateral threshold force applied against another one of the side walls.

2. The adjustable base assembly of claim 1 in which the pair of locking engagement surfaces includes a concave engagement surface of one of the base and the base mounting platform, and a complementary mating convex engagement surface of another of the base and base mounting platform that is snugly received within the concave surface.

3. The adjustable base assembly of claim 2 in which both the convex engagement surface and the complementary concave engagement surface include a pair of planar segments that meet along a line that is generally parallel to the one side of the base.

4. The adjustable base assembly of claim 2 in which both the convex engagement surface and the concave engagement surface include a pair of arcuate segments that meet along a line that is generally parallel to the one side of the base.

5. The adjustable base assembly of claim 2 in which the locking mating engagement surfaces extend in a direction that is substantially parallel to the one side of the base.

6. The adjustable base assembly of claim 2 in which the locking, mating engagement surfaces are adjacent to only the one side of the base.

7. The adjustable base assembly of claim 1 in which the non-locking, engagement surfaces are generally planer and meet along a single plane.

8. The adjustable base assembly of 7 in which the single plane forms a non-obtuse angle relative to the bottom of the base.

9. The adjustable base assembly of claim 8 in which the single plane forms an acute angle relative to the bottom of the base.

10. The adjustable base assembly of claim 9 in which the acute angle is in a range approximately between twenty degrees and seventy five degrees.

11. The adjustable base assembly of claim 8 in which the non-obtuse angle is a right angle.

12. The adjustable base assembly of claim 1 in which the non-locking, mating engagement surfaces are rigid and separable from each other in response to a lateral force against the other side of the base without distortion.

13. The adjustable base assembly of claim 1 including another pair of locking, mating engagement surfaces that prevents separation of the base from the base mounting platform in response to any lateral forces applied against a third one of the side walls of the base, and another pair of non-locking, mating engagement surfaces that enables relative movement between and separation of the base from the base platform in response to a preselected minimum lateral threshold force applied, against a fourth one of the side walls.

14. The adjustable base assembly of claim 13 in which the one side and the other side are opposite one another, and the third side and the fourth side are opposite one another.

15. The adjustable base assembly of claim 1 including another pair of mating, non-locking engagement surfaces that enables relative movement between and separation of the base from the base platform in response to another preselected minimum lateral threshold force applied against a third one of the side walls that is different from the preselected minimum lateral threshold force applied against the other one of the sidewalls.

16. The adjustable base assembly of claim 15 including a third pair of non-locking, mating engagement surfaces that enables relative movement between and separation of the base from the base platform in response to a preselected minimum lateral threshold force applied against a fourth one of the side walls that is different from the one and the other preselected minimum lateral threshold forces associated with the one side and the other side.

17. An adjustable base assembly, comprising:

a base with four side walls, a top and a bottom, the bottom having a central concavity defining a single female base connector with at least two pairs of female mating engagement surfaces that are adjacent to, and extend inwardly and upwardly from, two different ones of the four sidewalls at the bottom and at two different acute angles relative to the bottom;

a base mounting platform having a bottom, means for attaching the bottom of the base mounting platform to a generally horizontal playing surface, and a single male connector extending upwardly from the bottom of the base mounting platform and conformed in shape to the central cavity for snug mating receipt within the female base connector, said male connector including two pairs of male mating engagement surfaces for respective mating engagement with the two pairs of female engagement surface along said two different acute angles;

said two different acute angles of the engagement surfaces enabling relative sliding movement between and separation of the base from the base platform without significant distortion of any of the mating engagement surfaces in response to two different, minimum, lateral threshold forces against at least two different ones of the sidewalls from which the two different female engagement surfaces extend, respectively.

18. The adjustable breakaway base assembly of claim 17 including means for selectively locking one of the pairs of mating engagement surfaces to prevent separation of the base from the base mounting platform in response to any lateral forces applied against the one of the side walls to which the one of the pairs of mating engagement surfaces is adjacent.

19. The adjustable base assembly of claim 17 in which the single female connector and the single male connector define the only releasable connection between the base and the base mounting platform.

20. The adjustable base assembly of claim 17 the male base connector and the mating female connector having a third pair of mating locking engagement surfaces that prevent separation of the base from the base mounting platform in response to any lateral forces applied against a third one of the side walls of the base different from the two different ones of the sidewalls that allow relative sliding movement and separation.

21. The adjustable base assembly of claim 17 in which the two different ones of the sidewalls are opposite to one another.

22. An adjustable base assembly, comprising:

a base with four side walls, a top and a bottom, the bottom carrying a base connector;

a base mounting platform having a mating base connector releasably connectable with the base connector, and means for attaching a bottom of the base mounting platform against a playing surface;

the base connector and the mating base connector having at least one pair of mating engagement surfaces including a pair of non-locking, mating engagement surfaces that enables relative movement between and separation of the base from the base platform in response to a preselected minimum lateral threshold force applied against another one of the sidewalls, and means for selectively locking the pair of non-locking, mating engagement surfaces to prevent separation of the base from the base mounting platform, in response to any lateral forces applied against one of the side walls of the base.

23. The adjustable base assembly of claim 22 in which the means for locking is a member releasably attached to the bottom of the base and the bottom of the base mounting platform.

24. The adjustable base assembly of claim 23 in which the base is releasably attached by means of rotatable fasteners that extend through the base and into each of the bottom of the base and the bottom of the base mounting platform.

25. The adjustable base assembly of claim 22 in which the means for locking includes a movable latch with a latch holder mounted to the bottom of one of the base and the base mourning platform, and a latch member movably mounted to the latch holder for movement between an-unlocked position in which the latch holder extends beneath another one of the base and base mounting platform and an unlocked position in which the latch member is in a withdrawn position spaced from the other one of the base and base mounting platform.

26. The adjustable base assembly of claim 25 in which the latch is mounted for linear movement relative to the latch holder between the locked position and the unlocked position.

27. The adjustable base assembly of claim 25 in which the latch member is fixedly attached to the bottom of the base, and the latch member is mounted for sliding movement beneath the bottom of the base mounting platform.

28. The adjustable base member of claim 22 including another pair non-locking, mating engagement surfaces that enables relative movement between and separation of the base from the base platform in response to another preselected minimum lateral threshold force applied against another one of the sidewalls, and means for selectively locking the other pair of non-locking, mating engagement to prevent separation of the base from the base mounting platform in response to the any lateral forces applied against another one of the side walls of the base.

29. The adjustable base assembly of claim 28 including a third pair of non-locking, mating engagement surfaces that enables relative movement between and separation of the base from the base platform in response to a third preselected minimum lateral threshold force applied against another one of the sidewalls, and means for selectively locking the third pair of non-locking, mating engagement to prevent separation of the base from the base mounting platform in response to any lateral forces applied against a third one of the side walls of the base.

30. The adjustable base assembly of claim 29 including a fourth pair non-locking, mating engagement surfaces that enables relative movement between and separation of the base from the base platform in response to a fourth preselected minimum lateral threshold force applied against another one of the sidewalls, and means for selectively locking the third pair of non-locking, mating engagement to prevent separation of the base from the base mounting platform in response to any lateral forces applied against a fourth one of the side walls of the base.

31. The adjustable base assembly of claim 30 in which the one and the other preselected minimum lateral forces are the same and the one and other sides are adjacent to each other.

32. The adjustable base assembly of claim 31 in which the third preselected minimum lateral force is equal to the fourth preselected minimum force and both the third force and the fourth force are different from the one lateral force and the other lateral force and the third side and the fourth side are adjacent to each other.

33. The adjustable base assembly of claim 22 in which the non-locking mating surfaces engage along a plane that forms a non-obtuse angle relative to the bottom of the base and the bottom of the base mounting platform.

34. The adjustable base assembly of claim 1 in which one of the base connector and the mating base connector has a generally concave, hollow configuration, and the other one of the base connector and the mating base connector has a generally convex configuration that is complementary to the concave configuration that is received within the generally concave hollow configuration and substantially fills the generally concave configuration.

35. The adjustable base assembly of claim 34 in which the base connector has the generally concave hollow configuration that is formed within the base and extends upwardly into the base from the bottom of the base, and the mating base connector has the generally convex configuration that extends upwardly from the base mounting platform an into the concave hollow configuration of the base connector.

* * * * *